US006865866B2

(12) United States Patent
Hsieh

(10) Patent No.: US 6,865,866 B2
(45) Date of Patent: Mar. 15, 2005

(54) MAIL INSERTER

(76) Inventor: Elton Hsieh, No. 13, Lin 1, Chiao-Men, Hsin-pu, Hsin-chu, 305 (TW)

( * ) Notice: Subject to any disclaimer, the term of this patent is extended or adjusted under 35 U.S.C. 154(b) by 0 days.

(21) Appl. No.: 10/462,302

(22) Filed: Jun. 13, 2003

(65) Prior Publication Data

US 2004/0250517 A1 Dec. 16, 2004

(51) Int. Cl.[7] ..... B65B 43/26
(52) U.S. Cl. ..... 53/569
(58) Field of Search ..... 53/284.3, 381.5, 53/381.6, 381.7, 460, 476, 569, 55, 64, 75; 156/441, 442, 441.5, 442.1, 442.2, 442.3

(56) References Cited

U.S. PATENT DOCUMENTS 2,736,999 A * 3/1956 Rouan et al. ..... 53/284.3
4,715,164 A * 12/1987 Luperti et al. ..... 53/284.3
4,852,334 A * 8/1989 Auerbach ..... 53/284.3
4,924,652 A * 5/1990 Krasuski et al. ..... 53/55
5,081,825 A * 1/1992 Mrozinski ..... 53/284.3
5,255,498 A * 10/1993 Hotchkiss et al. ..... 53/284.3
5,301,935 A * 4/1994 Miki et al. ..... 53/284.3
5,466,327 A * 11/1995 Staniszewski ..... 156/442.1
5,511,357 A * 4/1996 Ricketts et al. ..... 53/55
5,569,327 A * 10/1996 Paradis et al. ..... 156/441.5
5,581,972 A * 12/1996 Antonelli ..... 53/284.3
5,630,312 A * 5/1997 Ballard et al. ..... 53/284.3
5,642,598 A * 7/1997 Cannaverde ..... 53/284.3
5,660,030 A * 8/1997 Auerbach et al. ..... 53/284.3
5,770,005 A * 6/1998 Staniszewski ..... 156/442.1
5,814,183 A * 9/1998 Miller ..... 156/442.2
5,904,644 A * 5/1999 Dronsfield ..... 53/284.3
5,950,399 A * 9/1999 Viens et al. ..... 53/284.3
6,122,899 A * 9/2000 Soderling ..... 53/460

* cited by examiner

*Primary Examiner*—Rinaldi I. Rada
(74) *Attorney, Agent, or Firm*—Ladas & Parry LLP

(57) ABSTRACT

A mail inserter for inserting a mail into an envelope having a flap and a throat, including: an envelope entry; an envelope carrier, provided downstream of the envelope entry; an envelope retainer, provided at the downstream of the envelope carrier; a mail entry, for advancing the mail into the mail inserter; a mail carrier, provided downstream of the mail entry; a sealer, provided downstream of the envelope retainer; wherein the envelope entry, envelope carrier, envelope retainer and sealer jointly form an envelope path, and the mail entry and, the mail carrier jointly form a mail path that merges into the envelope path after the mail carrier.

23 Claims, 10 Drawing Sheets

MAIL INSERTER

CROSS-REFERENCES TO RELATED APPLICATIONS

Not Applicable

STATEMENT REGARDING FEDERALLY SPONSORED RESEARCH OR DEVELOPMENT

Not Applicable

DESCRIPTION

1. Field of Invention

This invention is related to a mail inserter, particularly to one being compact and lightweight, and allowing on-line connection with a mail collator, a folding apparatus and a printer, such as a laser printer.

2. Background of Invention

Mail inserters are commonly used for inserting a folded mail into an envelope. Though there are several models of commercially available mail inserters that may achieve the above objectives, such conventional mail inserters use thrust to push the folded mail into an envelope such that the exact location of the folded mail cannot be properly controlled, whereby sometimes part of the folded mail is still left out of the envelope, or that the envelope may be displaced or tom by the excessive thrust upon insertion of the folded mail. As a result, the address shown on the folded mail may not be properly displayed through the window of a windowed envelope, or the resulting sealed envelope may have a muddled appearance because the flap is not be precisely folded and sealed to the back of the envelope.

Furthermore, conventional mail inserters cannot detect whether the throat of the envelope has been properly flipped, such that jamming can easily occurred while inserting the folded mail into the un-flipped envelope.

In addition, conventional mail inserters are generally large in size, which are not suitable for being used in regular office space but at a designated location, such as a mailroom.

The large size and heavy weight of conventional mail inserters prevents conventional mail inserters from being connected to a laser printer for on-line operations. In other words, the mails that have been folded for delivery must be first printed by printers and folded by a folding apparatus in batches and then transported to the mailroom. The batches of folded documents are then fed into the mail collators one by one and then inserted into envelopes. Apparently, such a process cannot meet the needs of print-on-demand and print-to-mail.

SUMMARY OF INVENTION

It is thus a primary objective of this invention is to provide a mail inserter capable of inserting a mail to a proper location in an envelope without the risk of tearing or displacing the envelope so as to ensure a neat appearance for the sealed envelope.

It is another objective of this invention to provide a mail inserter capable of ejecting an un-flipped envelope to eliminate jamming.

It is another objective of this invention to provide a compact and lightweight mail inserter.

It is a further objective of this invention is to provide a mail inserter that allows on-line connection with a collator, folding apparatus and a printer.

It is yet another objective of this invention is to provide a mail inserter that can meet the needs of print-on-demand and print-to-mail.

To achieve the above objectives, this invention provides a mail inserter for inserting a mail into an envelope having a flap and a throat, comprising: an envelope entry; an envelope carrier, provided downstream of the envelope entry; an envelope retainer, provided downstream of the envelope carrier; a mail entry, for advancing the mail into the mail inserter; a mail carrier, provided downstream of the mail entry; a sealer, provided downstream of the envelope retainer; wherein the envelope entry, envelope carrier, envelope retainer and sealer jointly form an envelope path, and the mail entry and the mail carrier jointly form a mail path that merges into the envelope path between the envelope carrier and the envelope retainer.

The structures and characteristics of this invention can be realized by referring to the appended drawings and explanations of the preferred embodiments.

BRIEF DESCRIPTIONS OF DRAWINGS

DETAILED DESCRIPTION OF INVENTION

Figure 1:
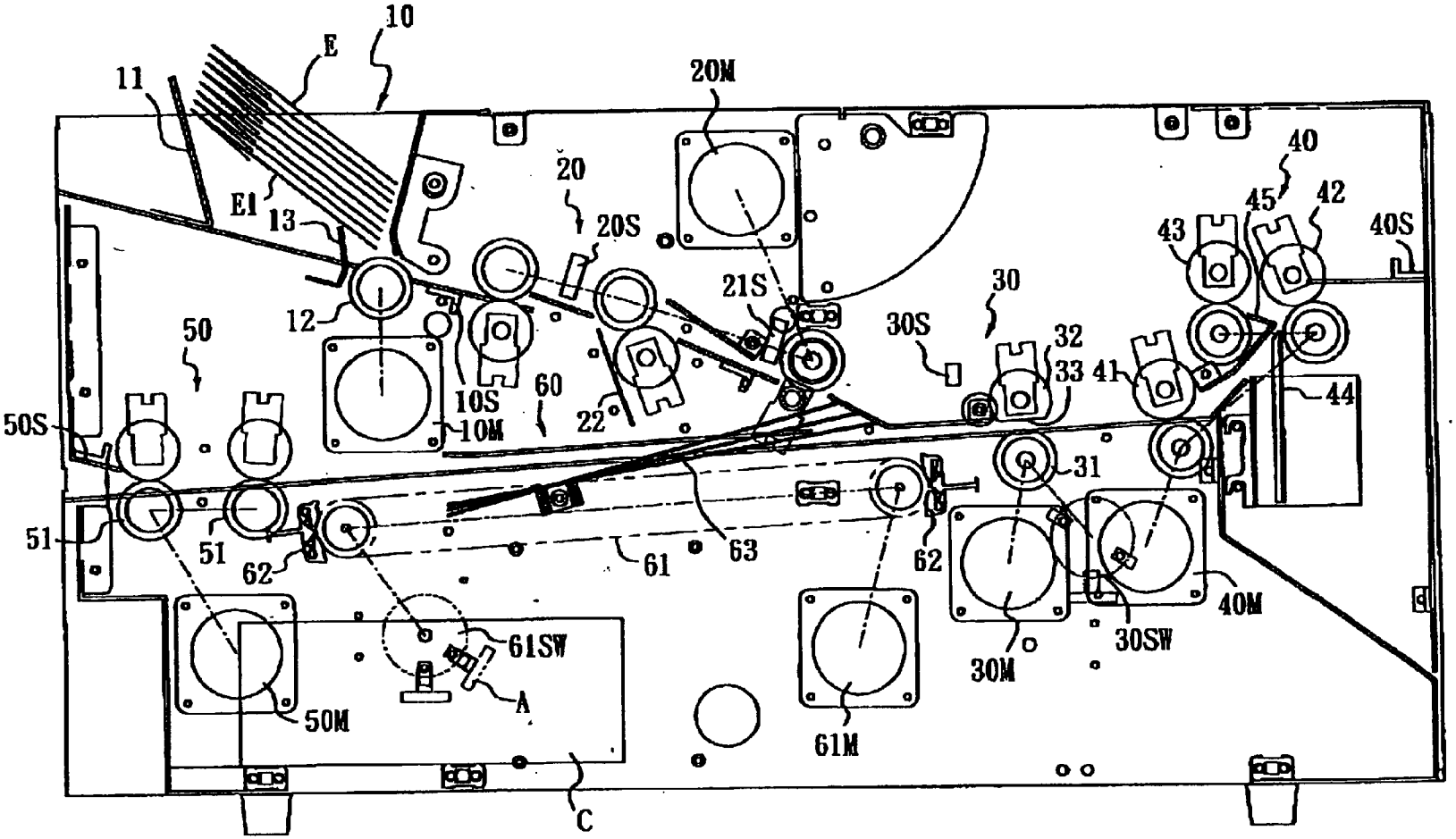
FIG. 1 is a schematic, cross-sectional view of a mail inserter according to this invention, illustrating the mail path and envelope path of the mail inserter.

FIG. 1 illustrates a schematic, cross-sectional view of a mail inserter 1 according to this invention, illustrating the mail path and envelope path of the mail inserter 1. The mail inserter 1 according to this invention comprises: an envelope entry 10, an envelope carrier 20, an envelope retainer 30 and a sealer 40 that are sequentially provided from an upstream to a downstream to form an envelope path; and a mail entry 50 and a mail carrier 60 that are sequentially provided from an upstream to a downstream beneath the envelope path to form a mail path that merges into the envelope path between the envelope carrier 20 and the envelope retainer 30.

Figure 2:
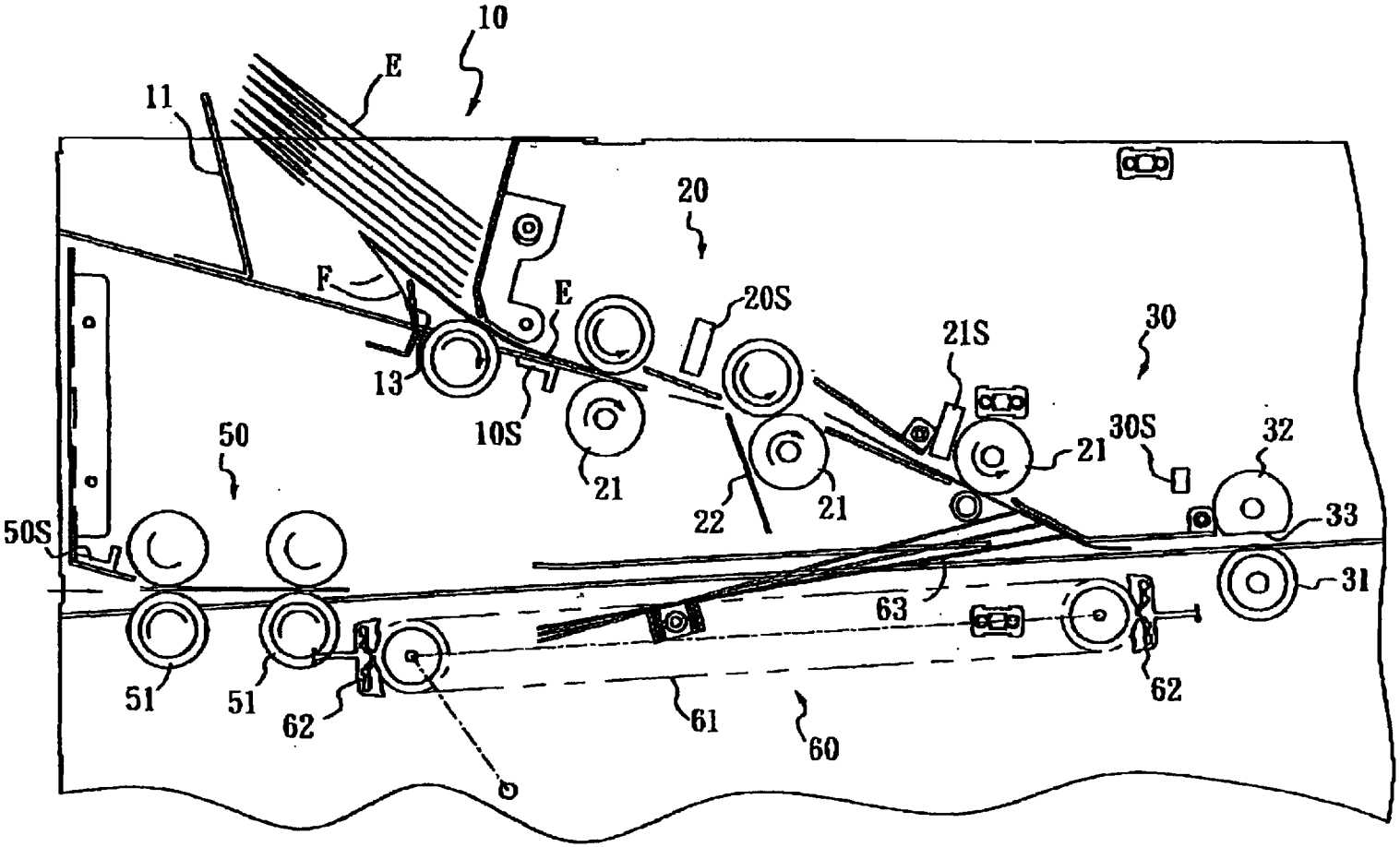
FIG. 2 is a schematic, cross-sectional view showing the mail entry of the mail inserter according to this invention, in which both the envelope and the mail start to enter the envelope path and mail path, respectively.
Figure 3:
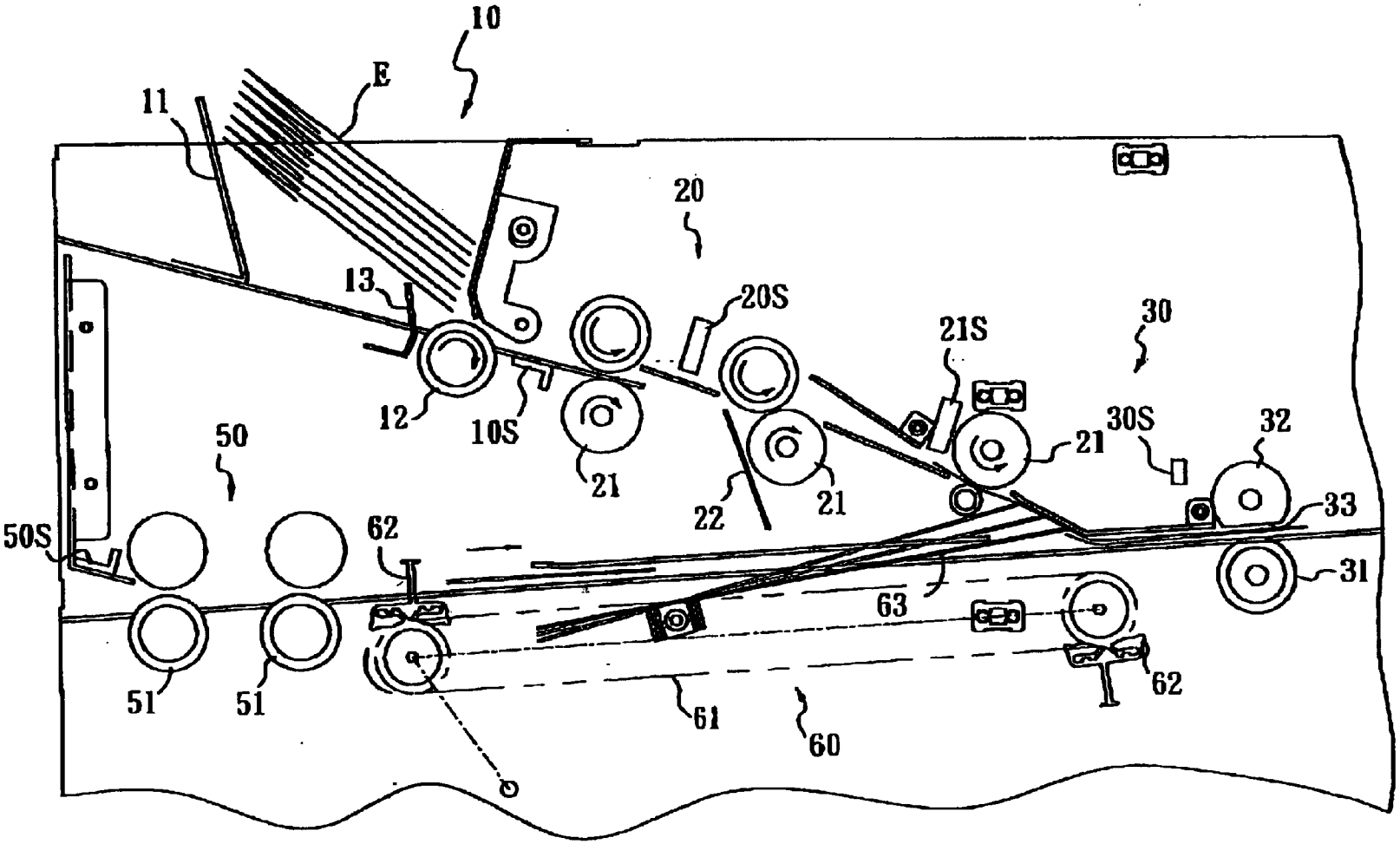
FIG. 3 is a schematic, cross-sectional view showing the mail entry of the mail inserter according to this invention, in which the flap is about to be separated from the envelope body by guides.
Figure 4:
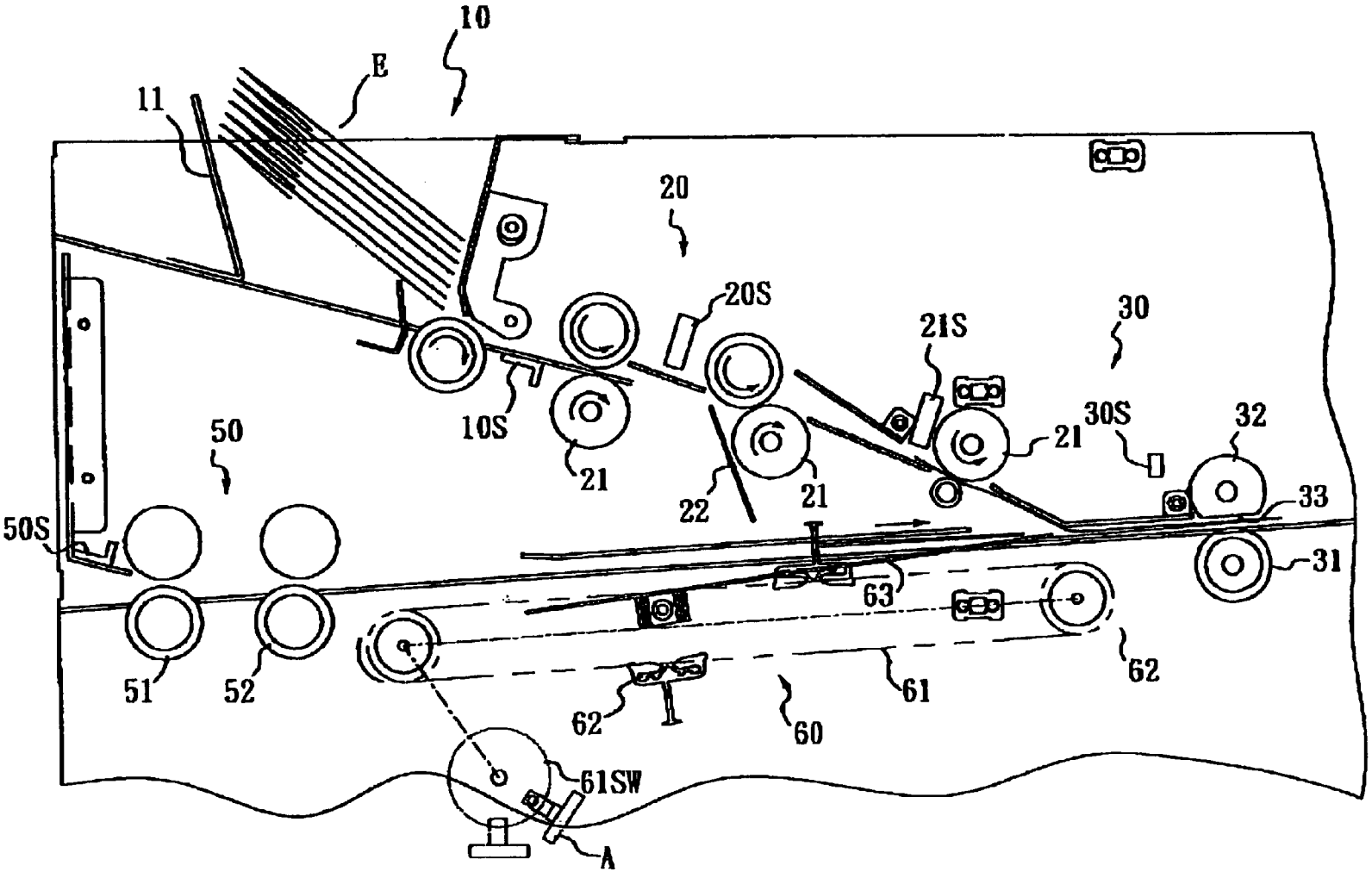
FIG. 4 is a schematic, cross-sectional view showing the mail entry of the mail inserter according to this invention, in which the mail is about to be inserted into the envelope.

FIGS. 2–4 illustrates the details of the envelope entry 10, envelope carrier 20, envelope retainer 30, mail entry 50 and mail carrier 60.

As shown in FIG. 1, the envelope entry 10 includes an envelope tray 11 for holding a stack of envelopes E, an envelope entry roller 12 for advancing the bottommost envelope E1 into the envelope carrier 20, a flap flipper 13 in the form of a panel located prior to the envelope entry roller 12 for separating a flap F from the envelope body to form an opened envelope, and an envelope entry sensor 10S located at an exit of envelope entry 10. The envelope entry roller 12 is driven by an envelope entry motor 10M.

With reference to FIGS. 2 and 3, the envelope carrier 20 includes a plurality of envelope carrier rollers 21 driven by an envelope carrier motor 20M (FIG. 1) for advancing the opened envelope through the envelope path to enter the envelope retainer 30, a first envelope carrier sensor 20S located along the envelope path within the envelope carrier 20, a second envelope carrier sensor 21S located at an exit of the envelope carrier 20, and preferably an auxiliary flap flipper 22 located along the envelope path within and beneath the envelope carrier 20.

The envelope retainer 30 includes a bottom envelope retainer roller 31 having a circular cross-section, a top envelope retainer roller 32 having a flat side 33, and an envelope retainer sensor 30S located at an entrance of the envelope retainer 30. The bottom envelope retainer roller 31 and the top envelope retainer roller 32 are driven by an envelope retainer motor 30M. The lower retainer roller 31 is coupled to an envelope retainer switch 30SW. The top envelope retainer roller 32 is normally situated such that the flat side 33 faces the bottom envelope retainer roller 31.

Returning to FIGS. 1 and 2, the mail entry 50 includes a plurality of mail entry rollers 51 driven by a mail entry motor 50M, and further includes a mail entry sensor 50S located at an entrance of the mail entry 50.

With reference to FIGS. 1–3, the mail carrier 60 includes a chain 61 coupling to a chain switch 61SW, and a plurality of tongues 62 provided on the chain 61 and protruding from the chain 61 at an equal distant from one another. Preferably, the chain 61 is provided with two tongues 62 as shown in the figures. The chain 61 is driven by a chain motor 61M (FIG. 1). The tongues 62 are at normal positions where neither tongue 62 impedes entry of the mail into the mail carrier 60, similar to that illustrated in FIGS. 1 and 2.

The mail carrier 60 further includes a plurality of guides 63 located below and protruding into the mail path within the mail carrier 60 and extending towards the envelope retainer 30.

Figure 6:
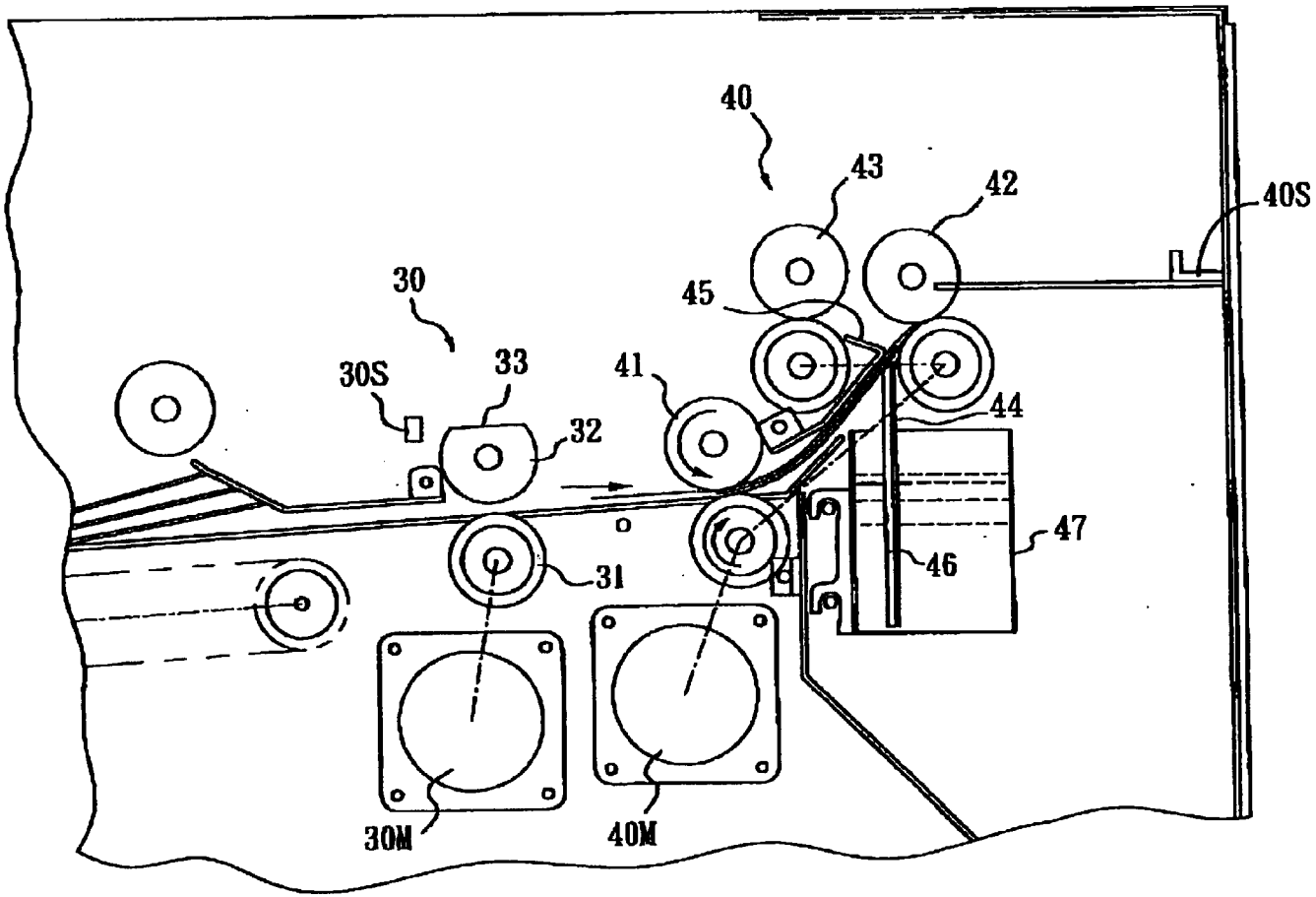
FIG. 6 is a schematic, cross-sectional, elevation view of the mail inserter according to this invention, in which the filled envelope has entered the sealer.
Figure 7A:
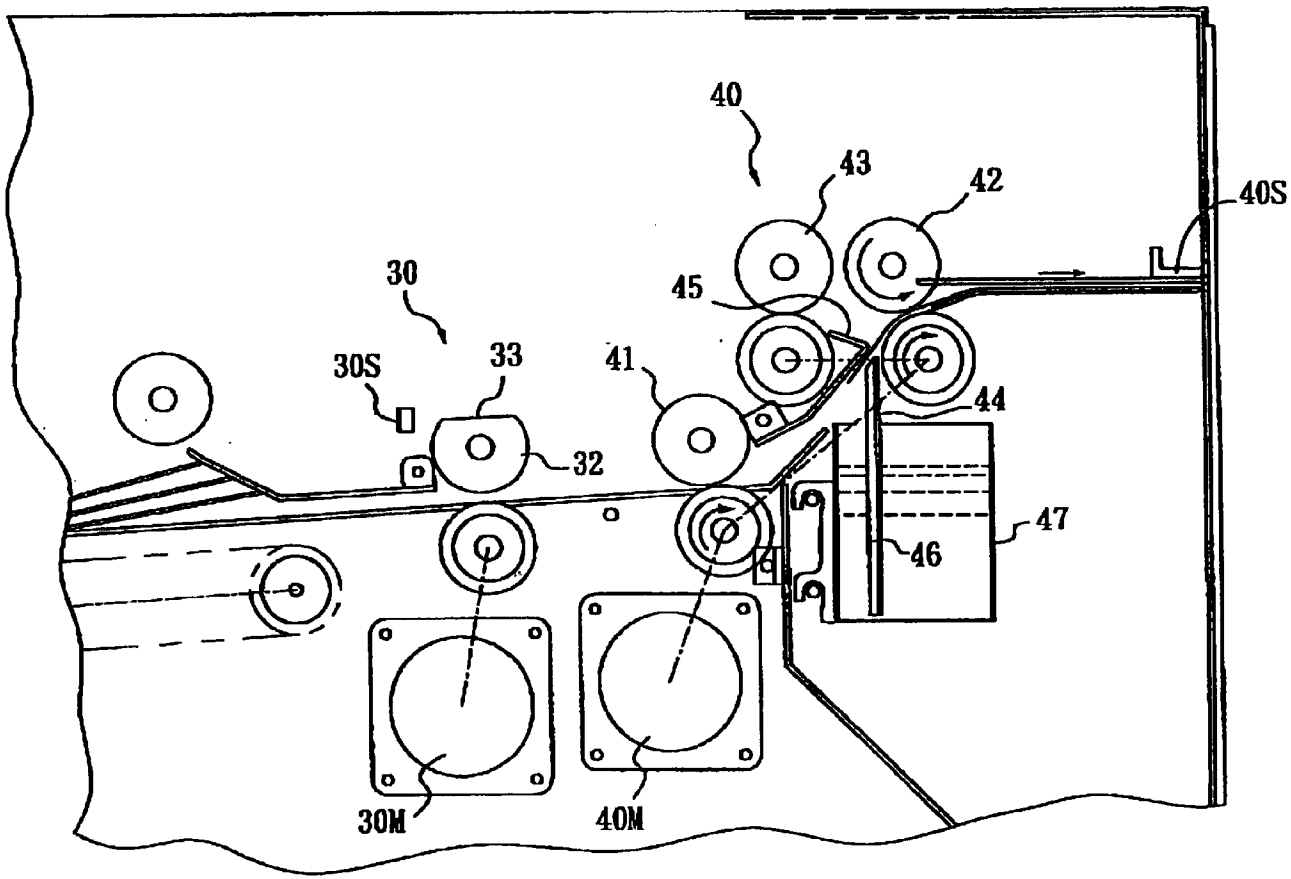
FIGS. 7(*a*) to 7(*d*) are schematic, cross-sectional views illustrating the various steps for sealing the flap to the back of the envelope in the sealer.
Figure 7B:
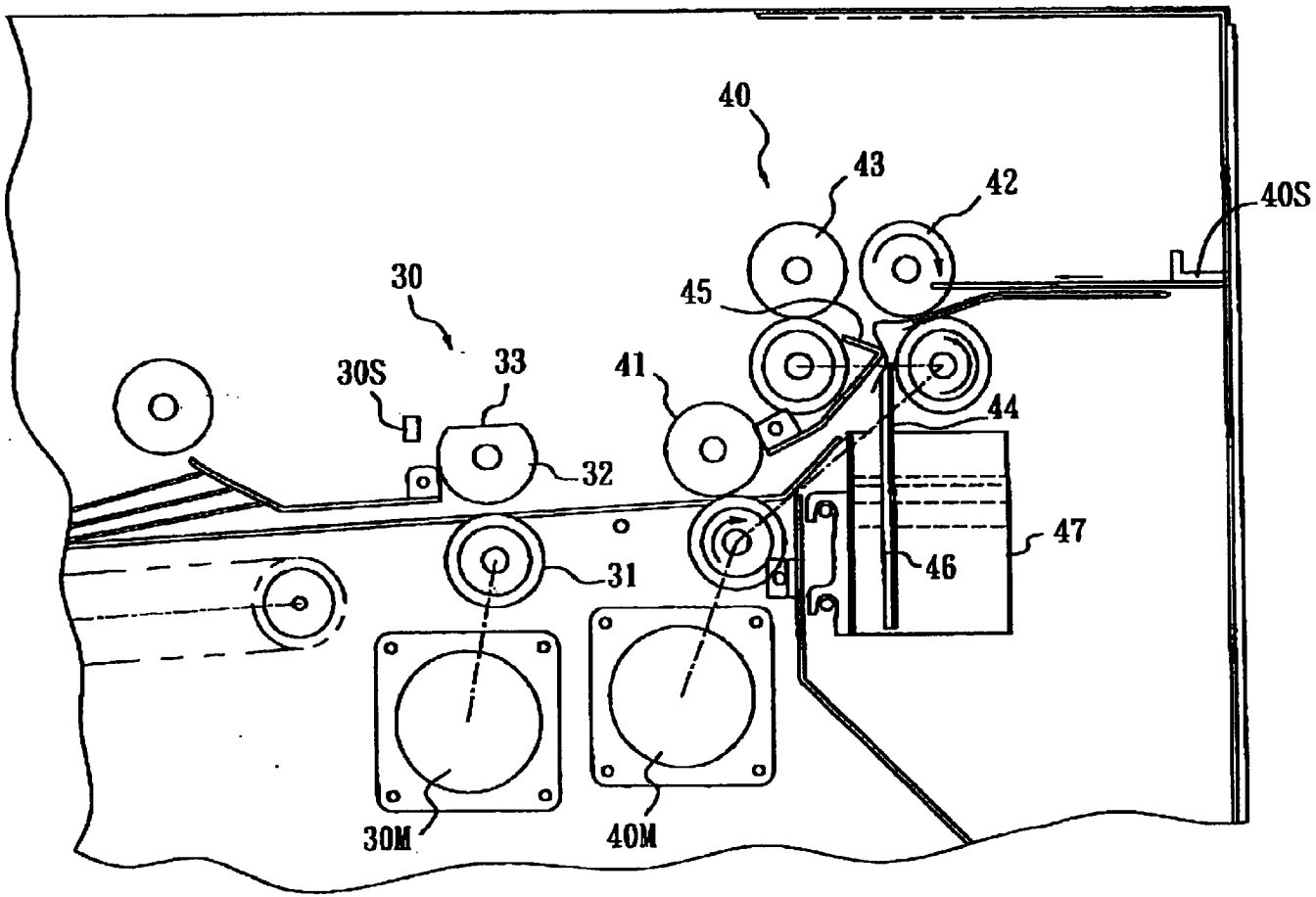
Figure 7C:
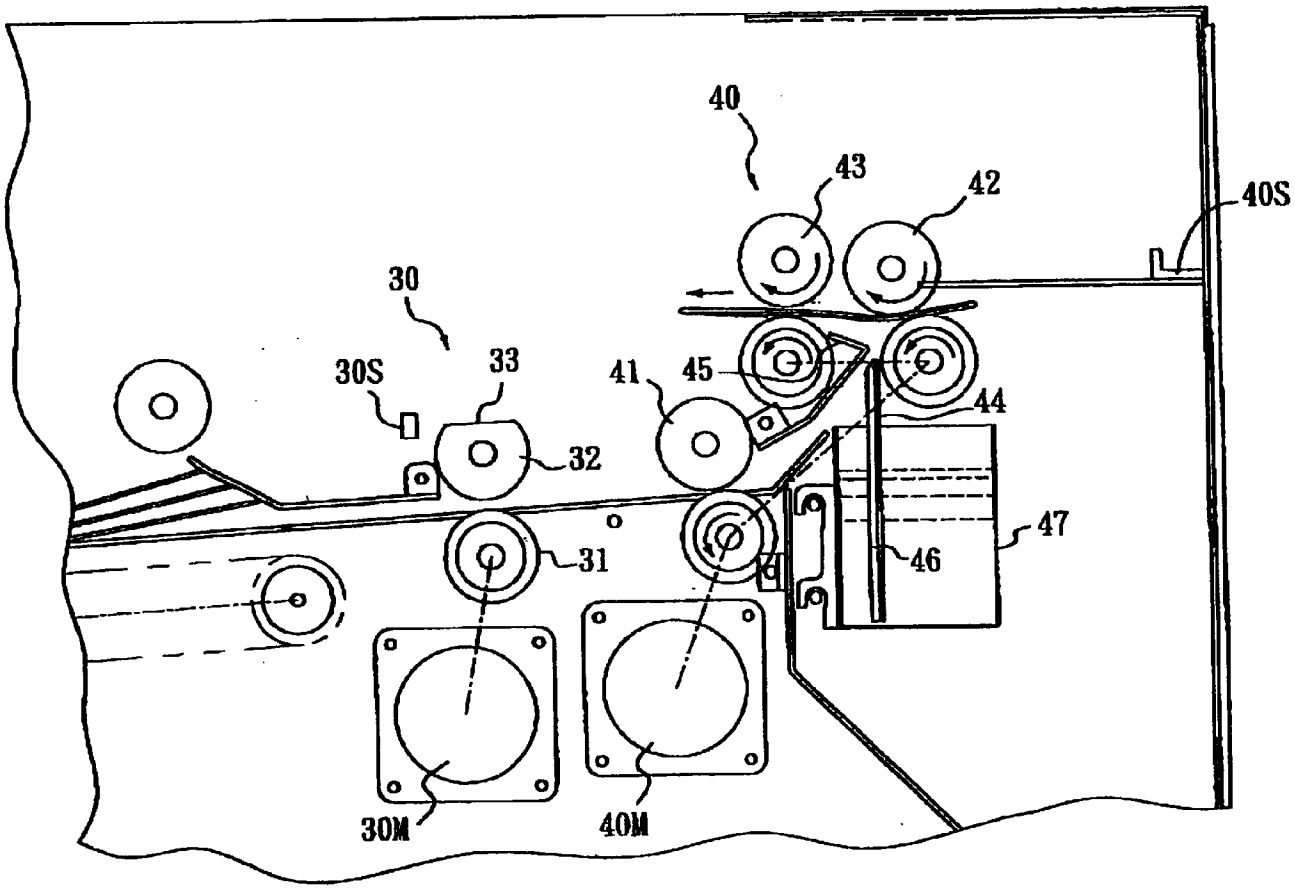
Figure 7D:
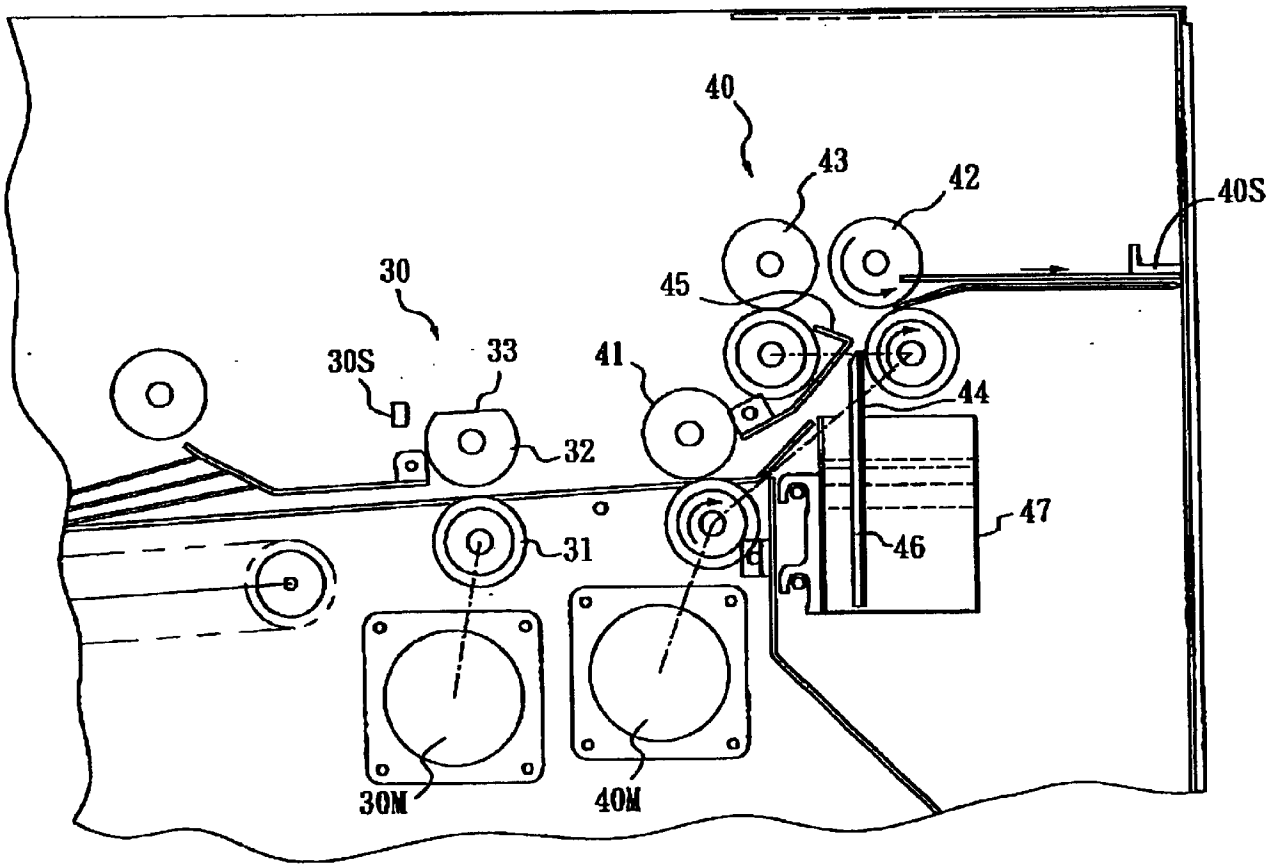

With reference to FIGS. 6 to 7(*d*), the sealer 40 includes a first pair of sealer rollers 41, a second pair of sealer rollers 42 and a third pair of sealer rollers 43 that are all driven by a sealer motor 40M. The second pair of sealer rollers 42 and the third pair of sealer rollers 43 are located downstream of and above the first pair of sealer rollers 41 in a side-by-side configuration with the third pair of sealer rollers 43 located between the first and second pairs of sealer rollers 41, 42. The sealer 40 further includes a water blade 44 located prior to the second pair of sealer rollers 42 and slightly recede away from the envelope path within the sealer 40, and a sealer sensor 40S located at an exit of the sealer 40, a baffle 45 located between the second pair of sealer rollers 42 and the third pair of sealer rollers 43 for guiding the filled envelope to proceed between the second and third pairs of sealer rollers 42, 43.

The water blade 44 according to this invention may include a sponge 46 that is inserted into a water basin 47 for supplying water to the water blade 44 by means of capillary action.

In operation and upon activating the mail inserter 1, the envelope entry motor 10M is activated to drive the envelope entry roller 12, subjecting the bottommost envelope E1 to advance towards the envelope carrier 20, as shown in FIG. 2.

When the mail entry sensor 50S detects that a mail is about to enter the mail entry 50, the mail entry motor 50M is activated to drive the mail entry rollers 51 subjecting a mail to enter the mail entry 50, as shown in FIG. 2.

When the bottommost envelope E1 passes through the flap flipper 13, the flap F is flipped from the envelope such that envelope may enter the envelope carrier 20 in an opened state. When the envelope entry sensor 10S detects that the bottommost envelope E1 about to enter the envelope carrier 20, the envelope carrier motor 20M is activated to drive the envelope carrier rollers 21, subjecting the bottommost envelope E1 to pass through the envelope carrier 20, and the envelope entry motor 10M is deactivated until being reactivated by the second envelope carrier sensor 21S indicating a properly opened envelope has entered the envelope retainer 30.

In case the envelope E1 is not flipped by the flap flipper 13, the auxiliary flap flipper 22 located along the envelope path within and beneath the envelope carrier 20 can serve to separate the flap F from the envelope body to form an opened envelope.

At the same time, the mail is advanced into the mail carrier 60 by the mail entry rollers 51.

When the envelope E1 passes through the envelope carrier 20, the first envelope carrier sensor 20S and the second envelope carrier sensor 21S detect whether the envelope E1 is properly opened by the flap flipper 13 or auxiliary flap flipper 22, by detecting the length of the envelope E1 passing through. For example, both envelope carrier sensors 20S, 21S must jointly determine the total length of the envelope E1 equals to the opened length of an envelope to confirm that the envelope E1 is properly opened.

If the envelope E1 is properly opened, the second envelope carrier sensor 21S will continue to detect whether the flipped envelope has completely left the envelope carrier 20, that is, a tail end of the flap F.

Because the top envelope retainer roller 32 is normally situated such that the flat side 33 faces the bottom envelope retainer roller 31, the opened envelope may be easily driven by the envelope carrier rollers 21 of the envelope carrier 20 into a gap formed between the bottom envelope retainer roller 31 and the top envelope retainer roller 32, as shown in FIG. 3. At the same time, when the second envelope carrier sensor 21S detects that the flipped envelope has completely left the envelope carrier 20, that is, the tail end of the flap F, the envelope carrier motor 20M is activated to drive in a reverse direction for a very short period of time and then deactivated until being reactivated by the envelope entry sensor 10S, to ensure that the guides 63 of the mail carrier 60 are inserted into the throat of the envelope.

If both envelope carrier sensors 20S, 21S confirm that the envelope E1 is properly opened, when the envelope retainer sensor 30S detects that the opened envelope is about to enter the envelope retainer 30, the chain motor 61M is activated to drive the chain 61 that is coupled to the chain switch 61SW, subjecting one of the tongues 62 to carry the mail through the guides 63 towards the envelope retainer 30, as shown in FIG. 3.

When the mail is carried through the guides 63, the mail adapts to force the guides 63 to recede from the mail path within the mail carrier 60 thereby further helping to open the envelope throat, as shown in FIG. 4, and subsequently inserting the mail into the opened envelope that is retained by the envelope retainer 30, to form a filled envelope.

At the same time that the tongue 62 is inserted into the opened envelope, the tongue 62 pushes the mail and the opened envelope further into the envelope retainer 30, so as to ensure that mail can reach the very inner edge of the opened envelope.

Figure 5:
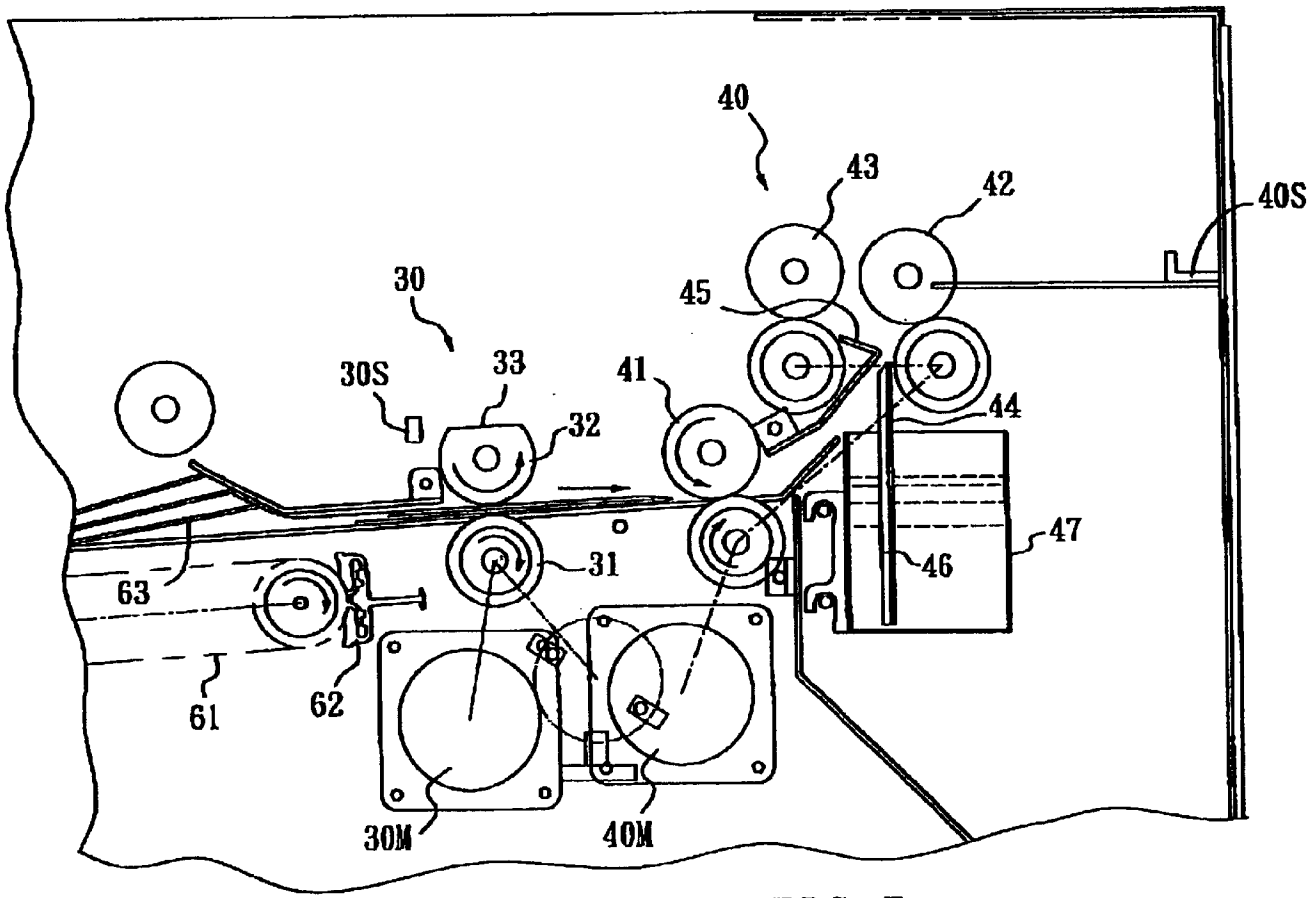
FIG. 5 is a schematic, cross-sectional view showing the mail exit of the mail inserter according to this invention, in which the filled envelope is about to enter the sealer.

At the same time the tongue 62 inserts the mail into the envelope, the chain switch 61SW reaches a first activating location A (FIG. 1) that activates the envelope retainer motor 30M to drive the top envelope retainer roller 32 and the bottom envelope retainer roller 31 that is coupled to the envelope retainer switch 30SW, subjecting the filled envelope to enter the sealer 40, as shown in FIG. 5. The chain 61 will pause for an appropriate duration before returning the tongues 62 to their normal positions and do not impede entry of the mail into the mail carrier 60, as shown in FIG. 5, and the chain switch 61SW coupled to the chain 61 also returns to its normal position and deactivates the chain motor 61M that waits to be reactivated by the envelope retainer sensor 30S.

The envelope retainer motor 30M is then deactivated by the envelope retainer switch 30SW when the top envelope retainer roller 32 returns to the normal position with the flat side 33 facing the bottom envelope retainer roller 31.

Furthermore, the chain switch 61SW activates the sealer motor 40M to drive the first, second and third pairs of sealer rollers 41, 42, 43 subjecting the filled envelope to pass thorough the first pair of sealer rollers 41 and second pair of sealer rollers 42, as shown in FIG. 6. When the filled envelope passes through the water blade 44, water is not yet dabbed onto the flap that is slight deflected away from the water blade 44 due the curving path, as shown in FIG. 7(*a*). Once the sealer sensor 40S detects that the filled envelope is about to leave the sealer 40, the sealer motor 40M is activated to rotate in a reverse direction for a pre-determined period of time, subjecting the filled envelope to travel backwards.

The baffle 45 located between the second pair of sealer rollers 42 and the third pair of sealer rollers 43 will cause the flap to deflect towards the water blade 44 and thus dabbing water onto adhesive that is commonly pre-applied to the flap, as shown in FIG. 7(*b*).

At the same time, the baffle 45 located between the second pair of sealer rollers 42 and the third pair of sealer rollers 43 prevents the filled envelope from returning to the original path, but instead guiding the envelope into the third pair of sealer rollers 43, as shown in FIG. 7(*c*), causing the flap F to fold towards the envelope so as to seal the flap to the back of the envelope to form a sealed envelope.

After the sealer motor 40M is activated to rotate in a reverse direction for the pre-determined period of time, subjecting the filled envelope to travel backwards, the sealer motor 40M is activated to rotate in a forward direction again, such as by a timing belt or an alternative sensor, subjecting the sealed envelope to pass through the second pair of sealer rollers 42 and exit the mail inserter 1, as shown in FIG. 7(*d*), and finally deactivated until being reactivated by the chain switch 61SW.

On the other hand, if the envelope E1 is not properly opened such as when the first and second envelope carrier sensor 20S and 21S jointly determine the total length of envelope E1 is less than the opened length of an envelope, or if two envelopes have be fed through the envelope entry 10 such as when the first and second envelope carrier sensor 20S and 21S jointly determine the total length of envelope E1 is more than the opened length of an envelope, the second envelope carrier sensor 21S will not activate the chain motor 61M, but the envelope entry motor 10M to advance the upcoming envelope as well as the retainer motor 30M and sealer motor 40M to eject the envelope(s) E1 through the remaining mail path and paper path.

The preferred embodiment as disclosed above implement plurality of sensors and switches for detecting the positions of the mail and the envelope thereby controlling activation and deactivation of the various motors. A logic program for controlling the operating logic and procedures may also be burned into a controller C (FIG. 1) for receiving signals transmitted by the sensors and switches and transmitting signals for activating or deactivating the motors, so as to achieve the intended operation as described above. Timing belts, however, may also be implemented to control the activation and deactivation of the various motors. For example, a further sealer sensor may also be provided at an exit of the third pair of sealer rollers 43 in the sealer 40 to detect whether the sealed envelope has exited through the third pair of sealer rollers 43, rather than using timing control.

Furthermore, persons skilled in sensor logics can easily modify the locations of the sensors and switches may also be varied in accordance with needs, so long as the logic program is designed to suit the various locations of the sensors and switches.

The mail inserter according this invention is capable of inserting a folded or a non-folded mail to a proper location in an envelope without the risk of tearing or displacing the envelope so as to ensure a neat appearance for the sealed envelope.

Furthermore, due to the compact and lightweight features provided by the mail inserter according to this invention, the mail inserter of this invention allows on-line connection with most of the commercially available mail folders, collators and laser printers and is suitable to be equipped in regular office space so as to meet the needs of print-on-demand and print-to-mail.

This invention is related to a novel creation that makes a breakthrough in the art. Aforementioned explanations, however, are directed to the description of preferred embodiments according to this invention. Various changes and implementations can be made by persons skilled in the art without departing from the technical concept of this invention. Since this invention is not limited to the specific details described in connection with the preferred embodiments, changes to certain features of the preferred embodiments without altering the overall basic function of the invention are contemplated within the scope of the appended claims.

Nomenclature Listing

C controller
E stacked envelopes
E1 bottommost envelope
F flap
1 mail inserter
10 envelope entry
10M envelope entry motor
10S envelope entry sensor
11 envelope tray
12 envelope entry roller
13 flap flipper
20 envelope carrier
20S first envelope carrier sensor
20M envelope carrier motor
21 envelope carrier rollers

21S second envelope carrier sensor
22 auxiliary flap flipper
30 envelope retainer
30M envelope retainer motor
30SW envelope retainer switch
31 bottom envelope retainer roller
32 top envelope retainer roller
33 flat side
40 sealer
40M sealer motor
40S sealer sensor
41 first pair of sealer rollers
42 second pair of sealer rollers
43 third pair of sealer rollers
44 water blade
45 baffle
46 sponge
47 water basin
50 mail entry
50M mail entry motor
50S mail entry sensor
51 mail entry rollers
60 mail carrier
61 chain
61M chain motor
61SW chain switch
62 tongues
63 guides

What is claimed is:

1. A mail inserter for inserting mail into an envelope having a flap and a throat, comprising:

an envelope entry for advancing the envelope into the mail inserter, including: a flap flipper for separating the flap from the envelope to form an opened envelope;

an envelope carrier provided downstream of the envelope entry, for advancing the opened envelope;

an envelope retainer provided downstream of the envelope carrier, for retaining the opened envelope advanced by the envelope carrier;

a mail entry for advancing the mail into the mail inserter;

a mail carrier provided downstream of the mail entry, including: a chain and a plurality of guides extending towards the envelope retainer, the chain carrying the mail through the guides towards the envelope retainer into the opened envelope to form a filled envelope;

a sealer provided downstream of the envelope retainer, including: a water blade for wetting the flap, and a baffle for folding the flap towards the envelope so as to seal the flap to the envelope to form a sealed envelope;

wherein the envelope entry, envelope carrier, envelope retainer and sealer jointly form an envelope path, and the mail entry and the mail carrier jointly form a mail path that merges into the envelope path between the envelope carrier and the envelope retainer, and wherein the sealer further includes: a first pair of sealer rollers for advancing the filled envelope into the sealer; a second pair of sealer rollers; a third pair of sealer rollers, the second pair of sealer rollers and the third pair of sealer rollers being located downstream of and above the first pair of sealer rollers in a side-by-side configuration with the third pair of sealer rollers located between the first and second pairs of sealer rollers; and wherein the water blade is located prior to the second pair of sealer rollers, and the baffle is located between the second fair of sealer rollers and the third pair of sealer rollers, the baffle guiding the filled envelope into the third pail of sealer rollers.

2. The mail inserter according to claim 1, wherein the envelope entry further includes an envelope entry roller and an envelope tray for holding a stack of envelopes, and wherein the flap flipper is located prior to the envelope entry roller.

3. The mail inserter according to claim 2, wherein the envelope carrier further includes an auxiliary flap flipper located along the envelope path within and beneath the envelope carrier.

4. The mail inserter according to claim 3, wherein the envelope entry roller is located below the envelope tray for advancing the bottommost envelope into the envelope carrier.

5. The mail inserter according to claim 4, wherein the envelope retainer includes a bottom envelope retainer roller having a circular cross-section and a top envelope retainer roller having a flat side.

6. The mail inserter according to claim 5, wherein the top envelope retainer roller is normally at a position that the flat side faces the bottom envelope retainer roller.

7. The mail inserter according to claim 6, wherein the chain of the mail carrier further includes a plurality of tongues protruding into the mail path within the mail carrier and located at an equal distant from one another.

8. The mail inserter according to claim 7, wherein the tongues are normally at positions so as not impede the entry of the mail into the mail carrier.

9. The mail inserter according to claim 8, wherein the plurality of guides are located below and protrude into the mail path within the mail carrier, whereby when the mail is carried through the guides by the one of the tongues, the mail forces the guides to recede from the mail path within the mail carrier, allowing the guides to insert the mail into the opened envelope to form a filled envelope.

10. The mail inserter according to claim 9, wherein the mail entry includes a plurality of mail entry rollers, a mail entry motor for driving the plurality of mail entry-rollers and a mail entry sensor located at an entrance of the mail entry.

11. The mail inserter according to claim 10, wherein the envelope carrier includes a first envelope carrier sensor located along the envelope path within the envelope carrier, a second envelope carrier sensor located at an exit of the envelope carrier, a plurality of envelope carrier rollers, and an envelope carrier motor for driving the plurality of envelope carrier rollers thereby advancing the opened envelope through the envelope path to enter the envelope retainer.

12. The mail inserter according to claim 11, wherein the envelope entry further includes an envelope entry sensor located at an exit of the envelope entry and an envelope entry motor for driving the envelope entry roller and wherein the envelope entry motor is activated by the second envelope carrier sensor to drive the envelope entry roller subjecting the bottommost envelope to enter the envelope carrier, and deactivated by the envelope entry sensor.

13. The mail inserter according to claim 12, wherein the envelope entry motor is activated when the mail entry sensor detects the mail entering the mail entry, and the envelope entry motor is deactivated when the envelope entry sensor detects the envelope entering the envelope carrier.

14. The mail inserter according to claim 13, wherein the envelope retainer further includes: an envelope retainer sensor located at an entrance of the envelope retainer, an envelope retainer motor for driving the top envelope retainer roller and bottom envelope retainer roller, and an envelope retainer switch being coupled to the bottom envelope retainer roller.

15. The mail inserter according to claim 14, wherein the mail carrier further includes a chain switch being coupled to the chain, a chain motor for driving the chain, and wherein the chain motor is controlled by the envelope retainer sensor, the first and second envelope carrier sensors, and deactivated by the chain switch.

16. The mail inserter according to claim 15, wherein the chain motor is activated by the second envelope carrier sensor after the first and second envelope carrier sensors detect that the envelope is properly opened and the envelope retainer sensor detects that the opened envelope is about to enter the envelope retainer, and the chain motor is deactivated when the tongues return to their normal positions so as to not impede the entry of the mail into the mail carrier.

17. The mail inserter according to claim 16, wherein the envelope retainer motor is activated by the chain switch to drive the top envelope retainer roller and the bottom envelope retainer roller subjecting the filled envelope to enter the sealer, and deactivated by the envelope retainer switch.

18. The mail inserter according to claim 17, wherein the envelope retainer motor is deactivated when the top envelope retainer roller returns to the normal position with the flat side facing the bottom envelope retainer roller.

19. The mail inserter according to claim 18, wherein the sealer further includes: a sealer motor for normally driving the first, second and third pairs of sealer rollers in a forward direction, a sealer sensor located at an exit of the sealer.

20. The mail inserter according to claim 19, wherein the sealer motor is activated by the chain switch to drive the first, second and third pairs of sealer rollers in a forward direction, and the sealer motor is activated by the sealer sensor to drive the first, second and third pairs of sealer rollers in a reverse direction for a pre-determined period of time, re-activated in a forward direction, and then deactivated.

21. The mail inserter according to claim 20, wherein the sealer motor is activated when the sealer sensor detects that the filled envelope is about to leave the sealer.

22. The mail inserter according to claim 1, wherein said water blade is adapted for slightly receding away from the envelope path within the sealer.

23. The mail inserter according to claim 21, wherein the sealer further includes a water basin and a sponge that is inserted into the water basin for supplying water to the water blade by means of capillary action.

* * * * *